US007290624B2

(12) United States Patent
Mocivnik et al.

(10) Patent No.: US 7,290,624 B2
(45) Date of Patent: Nov. 6, 2007

(54) METHOD AND DEVICE FOR DRILLING HOLES IN SOIL OR ROCK MATERIAL

(75) Inventors: Josef Mocivnik, Fohnsdorf (AT); René Egger-Mocivnik, Judenburg (AT)

(73) Assignee: "ALWAG" Tunnelausbau Gesellschaft m.b.H., Pasching (AT)

( * ) Notice: Subject to any disclaimer, the term of this patent is extended or adjusted under 35 U.S.C. 154(b) by 0 days.

(21) Appl. No.: 11/529,359

(22) Filed: Sep. 29, 2006

(65) Prior Publication Data

US 2007/0023204 A1 Feb. 1, 2007

Related U.S. Application Data

(63) Continuation of application No. PCT/AT2005/000102, filed on Mar. 22, 2005.

(30) Foreign Application Priority Data

Mar. 30, 2004 (AT) ..... A 564/2004

(51) Int. Cl.
*E21B 4/10* (2006.01)
*E21B 10/36* (2006.01)

(52) U.S. Cl. ..... 175/57; 175/96; 175/293; 175/415

(58) Field of Classification Search ..... 175/19, 175/57, 95, 96, 171, 203, 263, 293, 320, 175/381, 415
See application file for complete search history.

(56) References Cited

U.S. PATENT DOCUMENTS 901,392 A * 10/1908 Sigafoos ..... 175/189
1,062,050 A * 5/1913 Stewart ..... 175/96
1,461,713 A 7/1923 Gilman et al.
2,016,068 A 10/1935 Bannister
2,400,853 A 5/1946 Stilley
2,815,932 A * 12/1957 Wolfram ..... 175/288
3,773,121 A 11/1973 Ikeda
3,870,113 A 3/1975 Slawson
4,790,391 A 12/1988 Hamamura et al.
7,124,843 B2 * 10/2006 Hulkkonen et al. ..... 175/384

FOREIGN PATENT DOCUMENTS

AT 408472 B 4/2001
CH 613491 9/1979
DE 2157282 6/1972

(Continued)

*Primary Examiner*—Kenneth Thompson
(74) *Attorney, Agent, or Firm*—Jacobson Holman PLLC

(57) ABSTRACT

The invention relates to a method and device for the drilling, in particular the percussive drilling or rotary percussive drilling of holes (9) in the ground or in rock, a bore hole (9) being formed by a drill bit (1) that is mounted on a drill pipe (3), by a percussive and/or rotary movement. Several drill points (2), which can be coupled to the drill pipe (3) and driven independently of one another, are provided on the drill bit (1). According to the invention, the drill points (2) can be uncoupled from their rigid coupling to the drill pipe (3) upon completion of the drilling process and can be displaced towards the centre of the bore hole (9), thus permitting the entire drill bit (1) together with the drill points (2) and the drill pipe (3) to be simply and reliably removed upon completion of the bore hole (9).

16 Claims, 3 Drawing Sheets

FOREIGN PATENT DOCUMENTS

Figure 2:
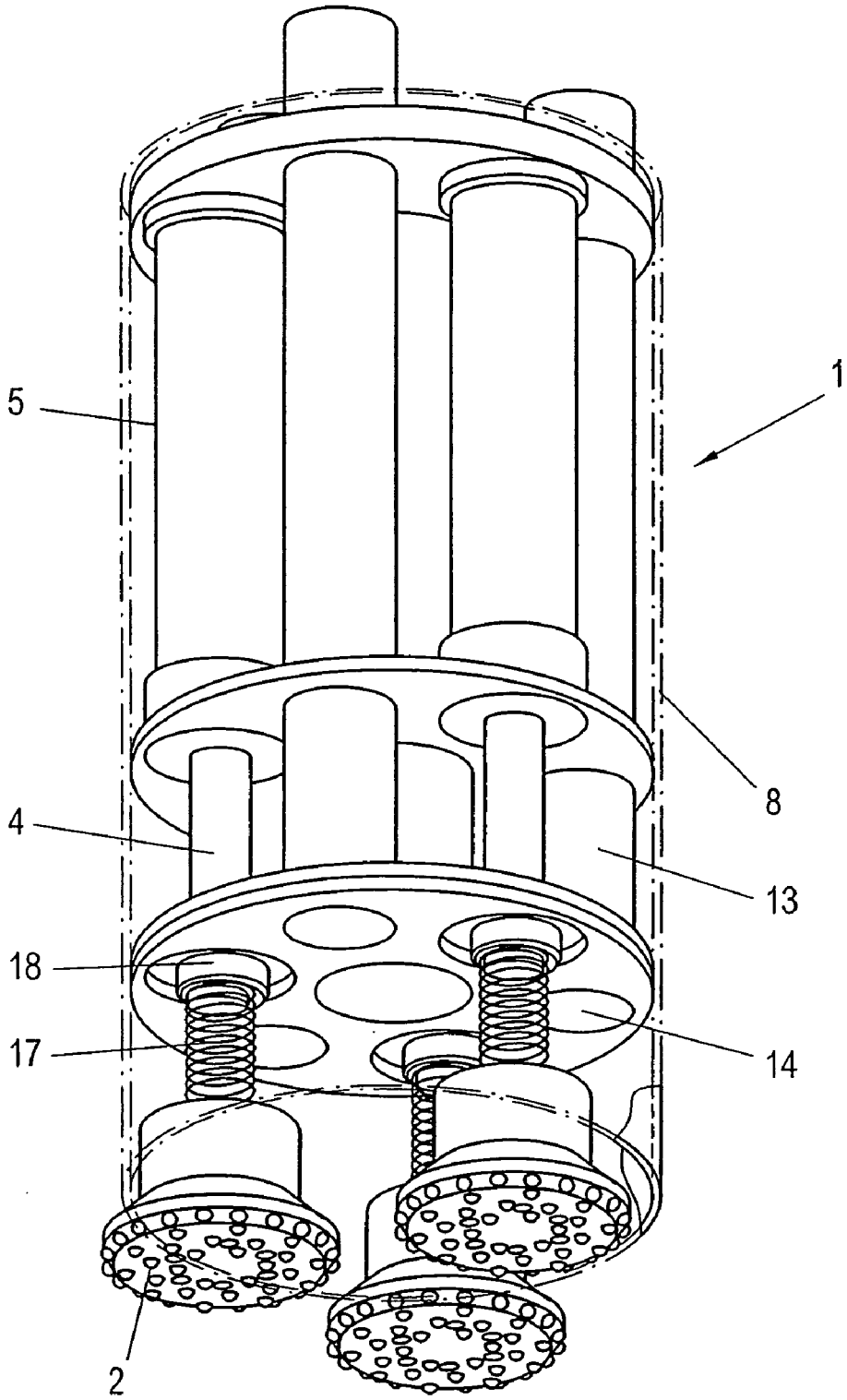

| | | | |
|---|---|---|---|
| DE | 2162314 | | 11/1972 |
| EP | 0444682 | A1 | 9/1991 |
| EP | 0563561 | B1 | 4/1997 |
| FR | 1407698 | | 11/1965 |
| WO | WO 9201856 | A1 * | 2/1992 |

* cited by examiner

FIG. 1
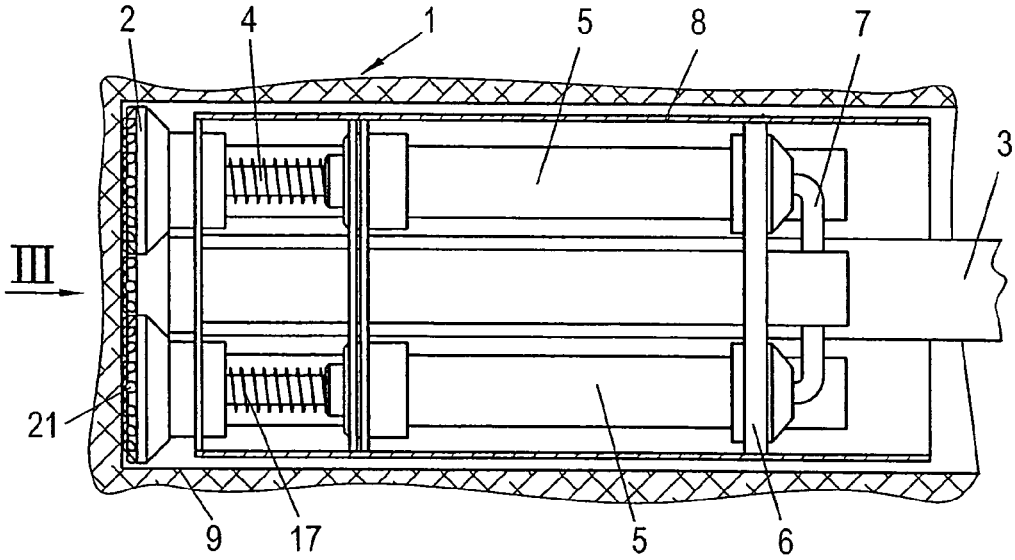
FIG. 1a
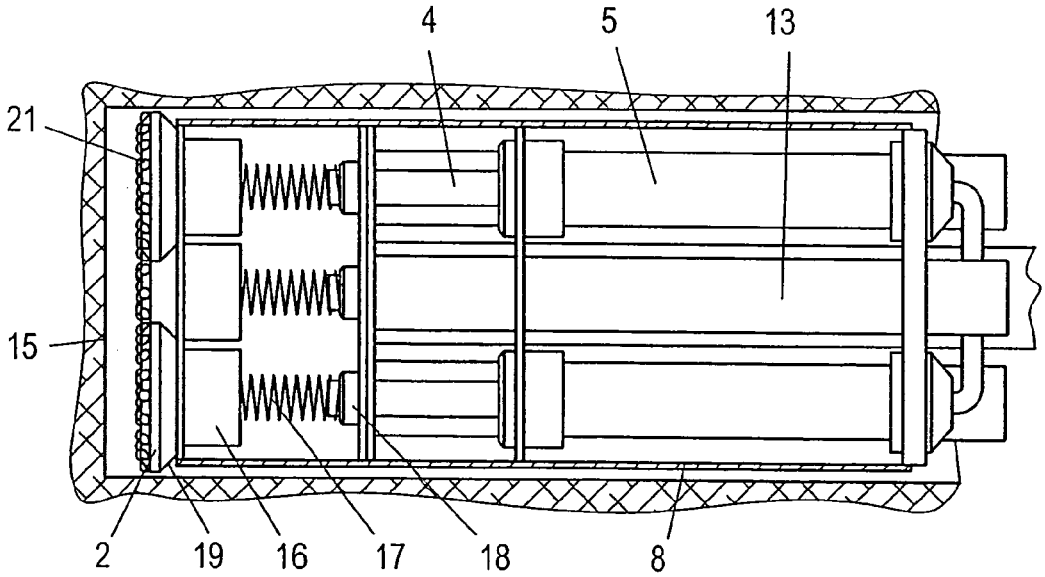
FIG. 1b

FIG. 1
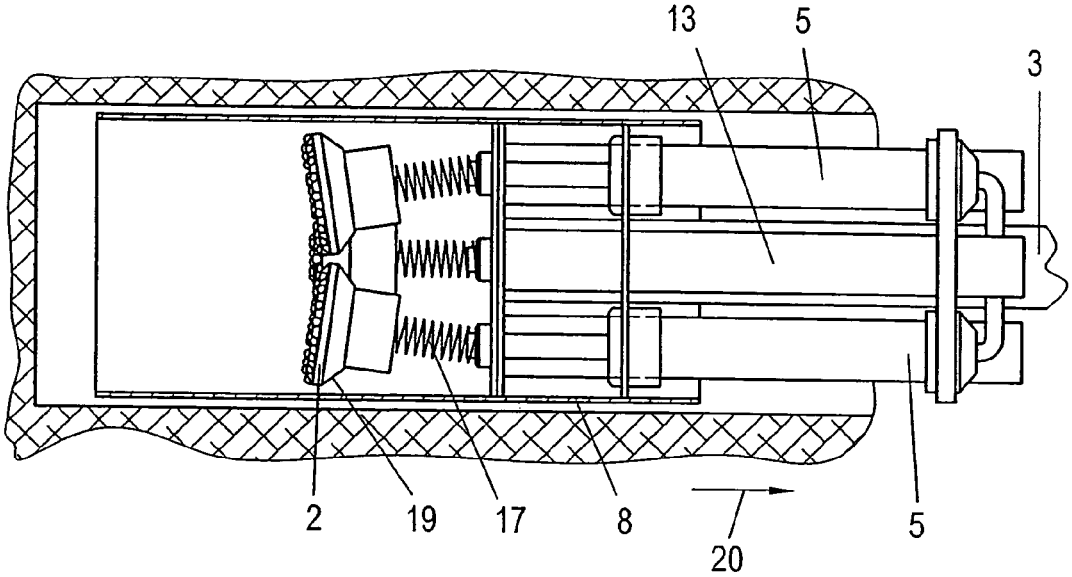
FIG. 1c
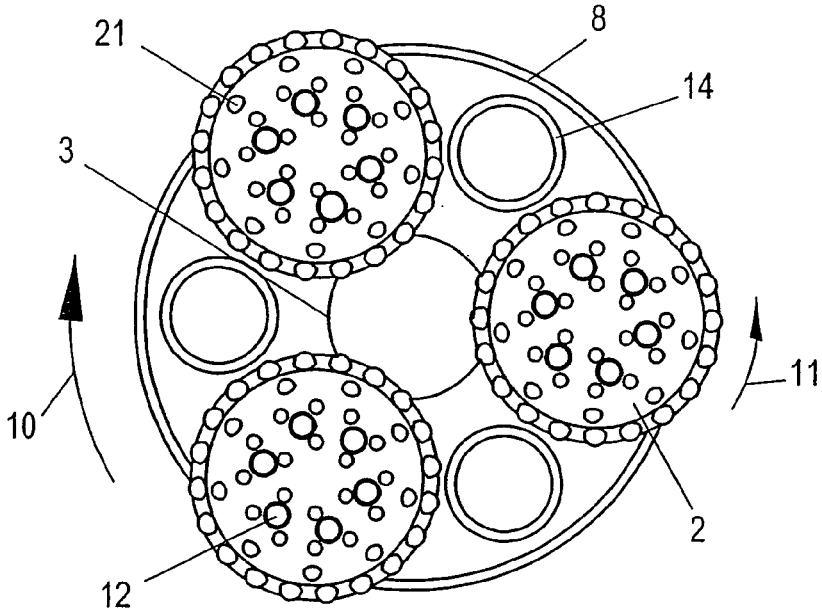
FIG. 3

METHOD AND DEVICE FOR DRILLING HOLES IN SOIL OR ROCK MATERIAL

This is a continuation of PCT/AT2005/000102 filed 22 Mar. 2005 and published in German.

FIELD OF THE INVENTION

The present invention relates to a method for drilling, in particular percussion drilling or rotary percussion drilling, holes in soil or rock material, wherein a borehole is formed by a percussive and/or rotational movement carried out by a drill bit mounted on a drill rod assembly, wherein a plurality of drill heads are provided on the drill bit, which are coupled with the drill rod assembly and driven independently of one another, and wherein the drill bit is removed from the borehole upon completion of a drilling procedure, wherein upon completion of the drilling procedure, the drill heads are decoupled from a rigid coupling with the drill rod assembly and mounted to be displaceable in the direction of the center of the borehole. The present invention further relates to a device for drilling, in particular percussion drilling or rotary percussion drilling, holes in soil or rock material, wherein a borehole is formed by a percussive and/or rotational movement carried out by a drill bit mounted on a drill rod assembly, wherein a plurality of drill heads are provided on the drill bit, which are coupleable with the drill rod assembly and drivable independently of one another, wherein the drill heads are decoupleable from a rigid coupling with the drill rod assembly and displaceable in the direction of the center of the borehole upon completion of the boring procedure.

PRIOR ART

In the context of methods and devices for drilling, in particular percussion drilling or rotary percussion drilling, holes in soil or rock material, various embodiments are known, especially for the production of boreholes having large cross sections or large clear widths and for the production of boreholes in which a jacket or envelope tube is introduced into the interior of the borehole substantially immediately during the production of the borehole. Thus, it is, for instance, known in the context of introducing an envelope or jacket tube, to use a drill bit that is divided into a pilot drill bit and an annular drill bit, whereby even boreholes having comparatively large dimensions can be reliably produced. In such a case, an envelope or jacket tube is, for instance, connected with the annular drill bit surrounding the pilot drill bit, whereupon, after the completion of the borehole, the pilot drill bit is detached from the annular drill bit and removed from the borehole along with the drill rod assembly, as can, for instance, be taken from AT-B 408 472. That known configuration, in particular, involves the disadvantage of at least the annular drill bit remaining in the borehole and, hence, being lost.

A method and a device according to the kind mentioned above can be taken from CH-A 613 491.

Moreover, modified configurations in which a plurality of separate drill heads form a drill bit are known to carry out the above-mentioned method, wherein it is, for instance, referred to U.S. Pat. No. 3,870,113, DE Pat. No. 2,162,314, U.S. Pat. No. 2,400,853, DE-A 2 157 282, U.S. Pat. No. 1,461,713 and U.S. Pat. No. 3,773,121. Those known configurations involve the disadvantage that, in particular, expensive and complex actuating means are provided for the individual and mutually separated drill heads. If an envelope or jacket tube is to be introduced into the interior of a borehole simultaneously with such actuating means, expensive pivoting mechanisms will have to be provided in order to optionally remove the drill bit formed by a plurality of drill heads as well as the drill rod assembly from the borehole upon completion of the same. If no envelope or jacket tube is employed with such means, such means can only be used in materials in which it is safeguarded that no breaking in of material into the borehole will have to be feared prior to the introduction of an envelope or jacket tube.

In the context of introducing an envelope or jacket tube during the production of a borehole as well as the subsequent option to remove the drill rod assembly along with the entire drill head or entire drill bit, it is, moreover, known, for instance, from EP-A 0 444 682 or EP-B 0 563 561 to provide displaceable elements on a drill bit, which are placeable into different pivot positions or operating positions, whereby it is to be ensured that a borehole diameter increased relative to that of an envelope or jacket tube to be introduced at the same time can be produced. With those known devices, it is aimed to pivot the pivotable drill bit parts into a retracted position upon completion of the borehole in order to enable the removal of the drill bit and drill rod assembly from the borehole upon completion of the same. Those known configurations involve the disadvantage of requiring complex mechanical drive systems for an appropriate displacement or pivoting-out of the individual drill head elements.

SUMMARY OF THE INVENTION

The present invention aims to further develop a method and device of the initially defined kind to the effect that the above-mentioned disadvantages will be avoided while, at the same time, ensuring, in particular, that the entire drill bit, which comprises a plurality of drill heads, as well as the drill rod assembly can be rapidly and reliably removed from the completed borehole upon completion of a borehole having, in particular, a large diameter or large clear width.

To solve these objects, the method according to the invention of the initially defined kind is essentially characterized in that the drill heads are connected with the drill bit via spring elements upon decoupling from the drill rod assembly and from the drive elements, respectively. Due to the fact that the drill heads can be decoupled from a rigid coupling with the drill rod assembly upon completion of the drilling procedure, which rigid or mechanically firm coupling with the drill rod assembly is disconnected for the realization of the drilling procedure and for the introduction of the mechanical forces required to perform the drilling procedure, it will subsequently be feasible in a simple manner to mount the drill heads in a manner displaceable in the direction of the center of the borehole such that, upon completion of the borehole and detachment of the rigid coupling with the drill rod assembly while reducing the outer diameter of the drill bit, which is defined by the drill heads, the entire drill bit including the plurality of drill heads can be removed from the borehole along with the drill rod assembly. For a particularly simple, yet reliable and stable connection after the disconnection of the rigid coupling between the drill heads and the drill rod assembly so as to enable the safe removal of the drill bit plus all of the drill heads from the interior of the borehole, according to the invention the drill heads are connected with the drill bit via spring elements upon decoupling from the drill rod assembly and from the drive elements, respectively. Such spring elements permit the substantially automatic displacement of the individual drill heads in the direction of the center of the borehole according to the respective requirements in order to enable the rapid and reliable removal of the drill bit and drill rod assembly. This does not depend on whether an envelope or jacket tube is at the same time introduced into the interior of the borehole during the drilling procedure, since even if such an envelope or jacket tube is not provided, the drill heads, for the proper removal of the entire drill bit together with the drill rods assembly from the interior of the borehole, have to be brought into a position in which their external dimensions are smaller than the internal dimensions of the borehole produced immediately before, in order to avoid excessive frictional forces between the borehole inner wall and the drill heads, which would otherwise counteract the simple and rapid removal of the drill rod assembly plus the drill bit. If an envelope or jacket tube is introduced into the interior of the borehole during the drilling procedure, the displacement of the individual drill heads in the direction of the interior or center of the borehole as proposed by the invention will safeguard that the elements or drill heads of the drill bit, which, for the production of the borehole, had to have a larger diameter than the simultaneously introduced envelope or jacket tube, will altogether be placeable or displaceable into a position now having a reduced external dimension relative to the inner diameter of the jacket tube in order to enable the passage of the entire drill bit with all the drill heads as well as the drill rod assembly for removal from the borehole.

In order to provide reliable coupling and decoupling between the drill heads and the drill rod assembly, it is provided according to a preferred embodiment that the drill heads are coupled with the drill rod assembly via rod assembly or drive elements which are displaceable within the interior of the drill bit substantially in the longitudinal direction of the drill bit. Such rod assembly or drive elements which are displaceable in the longitudinal direction of the drill bit or drill rod assembly allow for the safe and reliable mechanical or rigid coupling between the drill rod assembly and the individual drill heads performing the excavation work, while additionally ensuring the simple and reliable decoupling of the drill heads for an additionally provided displacement in the direction of the center of the borehole upon completion of the borehole or termination of the drilling procedure.

In order to achieve an adequate excavation performance, it is proposed according to a further preferred embodiment that the drill heads, in a manner known per se, are independently set in a percussive and/or rotational movement.

In order to prevent overheating of the drill heads or individual subregions of the same during the excavation operation, it is proposed according to a further preferred embodiment that the drill heads, in a manner known per se, are provided with a cooling or flushing fluid, which is preferably supplied within the interior of the rod assembly elements coupling the drill heads with the drill rod assembly.

For the proper haulage of the excavated material from the region of the drill heads, or the working face formed by the drill heads, it is provided according to a further preferred embodiment that excavated material is carried off from the working face between the drill heads and, in particular, via passage channels substantially extending in the longitudinal direction of the drill bit.

In order to achieve a rapid drilling progress even in the production of a bore having a large diameter or large clear width, it is proposed according to a further preferred embodiment that, in a manner known per se, at least three drill heads are arranged in a manner substantially symmetrically distributed about the working face of the drill bit.

To achieve the above-mentioned objects, a device of the initially defined kind is, moreover, essentially characterized in that the drill heads are coupled or coupleable via spring elements, in particular helical springs, surrounding, in particular, the rod assembly elements between the drill rod assembly and the drill heads. In order to achieve a sufficiently large displacement or relocation path of the individual drill heads in the direction towards the interior of the borehole while taking into account the conditions brought about by the borehole inner wall and an optionally simultaneously introduced envelope or jacket tube, according to the invention the drill heads are coupled or coupleable via spring elements, in particular helical springs, surrounding, in particular, the rod assembly elements between the drill rod assembly and the drill heads. Such spring elements enable the reliable coupling between the remaining partial regions of the drill bit and the drill heads as well as the simple and reliable adaptation to the conditions provided by the borehole inner wall, and an optionally present jacket tube, in respect to a reduction of the external dimensions of the drill heads required for the simple and rapid removal of the drill bit and drill rod assembly.

As already pointed out above, it is thus feasible in a simple manner to effect a disconnection of the rigid or mechanically firm coupling between the drill rod assembly and the drill heads upon completion of the drilling procedure so as to subsequently ensure, by the displacement or displaceability of the individual drill heads in the direction of the center of the borehole, that the entire drill with all the drill heads and the drill rod assembly will be reliably removed from the completed borehole. If an envelope or jacket tube is provided, the drill heads are displaceable into a position having an accordingly reduced outer periphery in order to enable a free passage through the interior of the envelope or jacket tube, which will remain in the interior of the borehole.

In order to provide proper coupling of the individual drill heads with the drill rod assembly as well as, upon completion of the borehole, reliable decoupling of the rigid or mechanically rigid connection between the drill rod assembly and the drill heads, it is proposed according to a further preferred embodiment that rod assembly or drive elements which are displaceable in the interior of the drill bit, particularly in the longitudinal direction of the same, are provided for the coupling of the drill heads with the drill rod assembly. Such rod assembly or drive elements which are, in particular, displaceable in the longitudinal direction of the drill bit or drill rod assembly provide a mechanical coupling sufficient for the production of a borehole and enable the simple release of this coupling upon completion of the borehole in order to subsequently permit the displaceability of the drill heads in the direction of the center of the borehole.

In order to provide reliable cooling of the drill heads during the excavation work, it is provided according to a further preferred embodiment that the drill heads, in a manner known per se, are provided with outlet openings for a cooling or flushing fluid capable of being supplied, in particular, through the rod assembly elements. For a structurally simple supply of the cooling or flushing fluid, it is preferably provided according to the invention that such a cooling or flushing fluid is supplied directly through the drive or rod assembly elements providing the coupling between the drill rod assembly and the drill head.

For the proper and reliable haulage of excavated material, it is, moreover, proposed that reception openings for the discharging of excavated material are provided on the working face of the drill bit between the drill heads, to which passage channels are connected in the interior of the drill bit, as in accordance with a further preferred embodiment of the device according to the invention.

For a structurally simple introduction of the energy required to perform the excavation work, it is provided according to a further preferred embodiment that each of the drill heads is actuatable by a percussion and/or rotary drive mounted in the interior of the drill bit and capable of being supplied with driving power via the common drill rod assembly.

As already indicated several times above, the immediate lining of the borehole during the drilling procedure is frequently required, in particular when producing a borehole in at least partially loose soil or rock material, in order to prevent material from breaking in during the drilling procedure, which would subsequently impede the removal of the drill rod assembly and the drill bit upon completion of the borehole. In this context, it is proposed according to a further preferred embodiment that the drill bit is surrounded by an envelope or jacket tube at least in its end region facing the interior of the borehole.

In order to enable the simple and reliable displacement of the drill heads in the direction of the center or interior of the borehole upon completion of the drilling procedure when using an envelope or jacket tube, it is provided according to a further preferred embodiment that, during the removal of the drill rod assembly and the drill bit upon completion of the drilling procedure, drill head rear sides facing away from the working face cooperate with the envelope or jacket tube, particularly via at least one chamfer.

SHORT DESCRIPTION OF THE DRAWINGS

In the following, the invention will be explained in more detail by way of exemplary embodiments schematically illustrated in the accompanying drawing. Therein:

FIG. 1 depicts partially sectioned, schematic side views of the individual steps of the method according to the invention using a device according to the invention for drilling holes in soil or rock material, FIG. 1*a* illustrating the drilling procedure, FIG. 1*b* depicting the position in which the rigid mechanical coupling between the drill heads and the drill rod assembly is released, and FIG. 1*c* illustrating the procedure of retracting the drill bit with all of the drill heads and the drill rod assembly upon displacement of the drill heads in the direction of the center of the borehole;

FIG. 2 is a perspective and enlarged view of the position of the drill heads in an illustration similar to that of FIG. 1*b;* and FIG. 3, on an enlarged scale, is a top view on the working face formed by the drill heads, for instance in the sense of arrow III of FIG. 1*a*.

DESCRIPTION OF THE PREFERRED EMBODIMENTS

In FIGS. 1 and 2, a drill bit is generally denoted by 1, comprising a plurality of drill heads 2, wherein, in the embodiment illustrated, three drill heads 2 are arranged in a substantially uniformly spaced-apart manner. The drill bit 1 is coupled with a drill rod assembly 3 schematically indicated in FIG. 1*a,* wherein each drill head 2 is coupled via a drive or rod assembly element denoted by 4 in FIG. 1*a,* via the interposition of a hammer 5 or percussion piece as a percussion and/or rotary percussion drive, said hammer 5 being coupled to the drill rod assembly 3 via a connection plate 6. To actuate the individual hammers 5 or percussion and/or rotary percussion drives, connection conduits 7 are, moreover, indicated between the drill rod assembly 3 and the individual hammers 5.

In addition, an envelope or jacket tube 8 is indicated in the Figures to surround the drill bit 1 at least in the foremost region, wherein said envelope or jacket tube 8 may optionally also extend substantially over the total length of the borehole 9, with the borehole inner wall to be produced by the drill heads 2 being schematically indicated at 9 in FIG. 1*a*.

As is apparent from the illustration according to FIG. 3, the drill bit 1 as a whole can be set in a rotational movement about the central axis defined by the drill rod assembly 3 in the sense of arrow 10, yet also the individual drill heads 2 can be set in rotational movements in the sense of arrow 11 such that, in the main, a borehole 9 having an accordingly large cross section or large clear width can be produced. From the illustration according to FIG. 3, it is further apparent that the drill heads are each provided with a plurality of outlet openings 12 for a cooling or flushing fluid, which cooling or flushing fluid can be supplied to the drill heads via the drive or rod assembly element 4 through a central channel. Excavation tools comprised, for instance, of hard-material elements or inserts are denoted by 21.

In addition, passages 13 are visible in the Figures between the individual drill heads 2 and hammers 5, respectively, which passages 13 serve the haulage of excavated material introduced into the passage channels 13 through passage openings 14. The passage channels 13 are extended in a non-illustrated manner as a function of the length of the borehole to be produced in order to enable the reliable haulage of excavated material.

Once the borehole 9 is completed, the rigid or direct mechanical coupling of the individual drill heads 2 with the drill rod assembly 3 via the interposition of the drive or drill rod assembly elements 4 and hammers 5 is interrupted or disconnected as indicated in FIGS. 1*b* and 2, thus causing the retraction of the hammers 5 as well as the drive or rod assembly elements 4 coupled therewith, into a position decoupled from the drill heads 2 as illustrated in FIGS. 1*b* and 2. In this state, the drill heads, on their ends 16 facing away from the working face 15, are coupled with articulation elements 18 via spring elements, in particular helical springs 17, so as to provide a movability and displaceability of the drill heads 2 via the resilient mounting of the drill heads 2.

During the retraction of the drill bit 1 with all the drill heads 2, a displacement or shift of the drill heads 2 in the direction towards the center of the borehole 9 is caused, as is clearly apparent from FIG. 1*c,* so as to obtain an accordingly elastic movability via the springs 17.

From the drawing, it is further apparent that the drill heads 2, on their rear sides facing the drill bit 1 or borehole interior, are each provided with a bevel 19 to enable the reliable entry into the interior of the envelope or jacket tube 8 at a removal of the drill bit 1 in the sense of arrow 20, as is indicated in FIG. 1*c*.

In the event that no envelope or jacket tube 8 is provided, the displacement or shift of the drill heads 2 to be effected via the spring elements 17 in the direction of the center of the borehole 9 likewise enables the simple and reliable removal of the entire drill bit 1 with all drill heads 2 and the drill rod assembly 3 in the sense of arrow 20 in FIG. 1*c,* since the drill heads 2 do not abut on the borehole inner wall and, hence, can be quickly removed from the borehole 9 without any friction with the borehole inner wall.

Deviating from the embodiment illustrated in the Figures, the three drill heads 2 may, for instance, be replaced with four or more drill heads 2 in order to provide an accordingly large working face. In this case, a central drill head may be provided, if it is ensured, for instance by different spring lengths, that, above all, the drill heads 2 located on the outer peripheral edge are accordingly displaceable towards the borehole interior after having been decoupled from the drill rod assembly 3 for removal from the borehole 9.

The invention claimed is:

1. A method for drilling holes in soil or rock material, comprising the steps of:

forming a borehole by a percussive and/or rotational movement carried out by a drill bit mounted on a drill rod assembly, providing a plurality of drill heads the drill bit, which are coupled with the drill rod assembly via rod assembly elements and driven independently of one another, removing the drill bit from the borehole upon completion of a drilling procedure, upon completion of the drilling procedure, decoupling the drill heads from a rigid coupling with the drill rod assembly and mounting the drill heads to be displaceable in the direction of the center of the borehole, and connecting the drill heads with the drill bit via spring elements upon decoupling from the drill rod assembly and from said rod assembly elements, respectively.

2. The method according to claim 1, wherein the drill heads are coupled with the drill rod assembly via the rod assembly elements which are displaceable within the interior of the drill bit substantially in the longitudinal direction of the drill bit.

3. The method according to claim 1, wherein the drill heads, are independently set in a percussive and/or rotational movement.

4. The method according to claim 1, wherein the drill heads are provided with a cooling or flushing fluid, which is supplied within the interior of the rod assembly elements coupling the drill heads with the drill rod assembly.

5. The method according to claim 1, wherein at least three drill heads are arranged in a manner substantially symmetrically distributed about the working face of the drill bit.

6. The method according to claim 1, wherein the method is used for percussion drilling or rotary percussion drilling.

7. The method according to claim 1, wherein excavated material is carried off from the working face between the drill heads.

8. The method according to claim 7, wherein excavated material is carried off from the working face between the drill heads via passage channels substantially extending in the longitudinal direction of the drill bit.

9. A device for drilling holes in soil or rock material, wherein a borehole is formed by a percussive and/or rotational movement carried out by a drill bit mounted on a drill rod assembly, wherein a plurality of drill heads are provided on the drill bit, which are coupleable with the drill rod assembly and drivable independently of one another, wherein the drill heads are decoupleable from a rigid coupling with the drill rod assembly and displaceable in the direction of the center of the borehole upon completion of the boring procedure, wherein the drill heads are coupled or coupleable via spring elements surrounding rod assembly elements between the drill rod assembly and the drill heads.

10. The device according to claim 9, wherein the rod assembly elements which are displaceable in the interior of the drill bit in the longitudinal direction of the same, are provided for the coupling of the drill heads with the drill rod assembly.

11. The device according to claim 9, wherein the drill heads, are provided with outlet openings for a cooling or flushing fluid capable of being supplied through the rod assembly elements.

12. The device according to claim 9, wherein reception openings for the discharging of excavated material are provided on the working face of the drill bit between the drill heads, to which passage channels are connected in the interior of the drill bit.

13. The device according to claim 9, wherein each of the drill heads is actuatable by a percussion and/or rotary drive mounted in the interior of the drill bit and capable of being supplied with driving power via the common drill rod assembly.

14. The device according to claim 9, wherein the spring elements are helical springs.

15. The device according to claim 9, wherein the drill bit is surrounded by an envelope or jacket tube at least in its end region facing the interior of the borehole.

16. The device according to claim 15, wherein, during the removal of the drill rod assembly and the drill bit upon completion of the drilling procedure, drill head rear sides facing away from the working face cooperate with the envelope or jacket tube via at least one chamfer.

* * * * *